US009671207B2

(12) United States Patent
Van Wyk

(10) Patent No.: US 9,671,207 B2
(45) Date of Patent: Jun. 6, 2017

(54) DETONATOR IDENTIFICATION AND TIMING ASSIGNMENT

(71) Applicant: DETNET SOUTH AFRICA (PTY) LIMITED, Woodmead (ZA)

(72) Inventor: Riaan Van Wyk, Woodmead (ZA)

(73) Assignee: DETNET SOUTH AFRICA (PTY) LTD (ZA), Woodmeed (ZA)

( * ) Notice: Subject to any disclaimer, the term of this patent is extended or adjusted under 35 U.S.C. 154(b) by 0 days.

(21) Appl. No.: 14/916,510

(22) PCT Filed: Aug. 26, 2014

(86) PCT No.: PCT/ZA2014/000042

§ 371 (c)(1),
(2) Date: Mar. 3, 2016

(87) PCT Pub. No.: WO2015/039148

PCT Pub. Date: Mar. 19, 2015

(65) Prior Publication Data

US 2016/0195379 A1 Jul. 7, 2016

(30) Foreign Application Priority Data

Sep. 3, 2013 (ZA) ..... 2013/06594

(51) Int. Cl.
*F42D 5/02* (2006.01)
*F42D 1/05* (2006.01)
(Continued)

(52) U.S. Cl.
CPC ..... *F42D 5/02* (2013.01); *C06C 7/00* (2013.01); *F42C 11/06* (2013.01); *F42D 1/05* (2013.01); *F42D 1/055* (2013.01)

(58) Field of Classification Search
CPC ... F24D 5/02; F24D 1/045; F24D 1/05; C06C 7/00
See application file for complete search history.

(56) References Cited

U.S. PATENT DOCUMENTS 5,125,104 A * 6/1992 Ohkawa ..... G01S 5/04 102/209
6,079,333 A * 6/2000 Manning ..... F42D 1/05 102/200
2004/0225431 A1* 11/2004 Aebi ..... F42D 1/055 701/110

FOREIGN PATENT DOCUMENTS

AU 591366 11/1989
DE 3809346 9/1989
(Continued)

OTHER PUBLICATIONS

International Search Report from the International Searching Authority for Application No. PCT/ZA2014/000042 dated Jan. 4, 2016 (5 pages).

(Continued)

*Primary Examiner* — Stephen M Johnson
(74) *Attorney, Agent, or Firm* — Michael Best & Friedrich LLP

(57) ABSTRACT

A device for use in a blasting system which Includes a plurality of detonators, wherein the device Includes a connector for making a connection between the detonator and a harness in the blasting system, wherein the connector includes a housing and at least one Identifying source on the housing operable to emit an identifying signal thereby to Identify the physical location of the housing.

13 Claims, 4 Drawing Sheets

(51) Int. Cl.

| | |
|---|---|
| ***C06C 7/00*** | (2006.01) |
| ***F42C 11/06*** | (2006.01) |
| ***F42D 1/055*** | (2006.01) |

(56) References Cited

FOREIGN PATENT DOCUMENTS

| | | |
|---|---|---|
| FR | 2551198 | 3/1985 |
| GB | 2227819 | 8/1990 |
| GB | 2299850 | 10/1996 |
| WO | 94/15169 | 7/1994 |
| WO | 2006122331 | 11/2006 |
| WO | 2007124539 | 8/2007 |

OTHER PUBLICATIONS

Written Opinion from the International Searching Authority for Application No. PCT/ZA2014/000042 dated Jan. 4, 2016 (7 pages).

* cited by examiner

DETONATOR IDENTIFICATION AND TIMING ASSIGNMENT

BACKGROUND OF THE INVENTION

This invention relates generally to a blasting system and more particularly is concerned with identifying a physical location of a detonator in a blasting system and assigning accurate timing data to the detonator.

The establishing of a blasting system in an underground environment can be problematic for, usually, arduous conditions prevail. Once blast holes have been drilled and prepared, detonators must be loaded into the respective blast holes and interconnected to a blasting machine. Correct timing sequences must be assigned to the detonators. Skilled personnel should be used to establish the blasting system but, even so, such personnel may become fatigued and make mistakes.

An object of the present invention is to address, at least to some extent, the aforementioned situation.

SUMMARY OF THE INVENTION

The invention provides, in the first instance, a device for use in a blasting system which includes a plurality of detonators, wherein the device is associated with one detonator and includes an identifying source which is actuable to emit an identifying signal at a frequency in a defined frequency range thereby to identify a physical location of the detonator.

The identifying signal may have a frequency in the ultraviolet, infrared or optical, frequency range. In use the frequency of the identifying signal is chosen to take into account and thereby limit the effects of noise and stray signals which could interfere with the identifying signal.

The identifying source may be any appropriate signal emitter working for example in the ultraviolet or infrared range. In one form of the invention the identifying source is a light source, typically an LED, mounted inside or on the detonator, and a light conductor, such as an optical fibre or light pipe, is used to transmit light from the light source to a position at which the light is visible, for example, depending on the situation, out of a borehole in which the detonator is installed, or to a connector which is used to couple the detonator via a branch line to a harness, or the like.

More generally, particularly if the identifying signal is not at a light frequency, an alternative conductor may be used to transmit the identifying signal from the source to a position at which the identifying signal is detectable.

In a different form of the invention the device includes a connector for making a connection between the detonator and a harness in the blasting system, wherein the connector includes a housing and at least one identifying source on the housing operable to emit an identifying signal thereby to identify the physical location of the housing.

The signal may be at any appropriate frequency and, for example, may be at a frequency which is in the infrared spectrum, in a visible or optical frequency range or in the ultraviolet spectrum. The frequency of the signal may be selected taking into account various factors including the likelihood of the emission of stray signals (noise) at frequencies which may interfere with the intended operating frequency.

The identifying source, upon operation, may function so that the identifying signal is emitted continuously, intermittently, or in a pulsed mode. In the last-mentioned case the identifying source could be pulsed in a coded manner so that the source or housing is uniquely identified. This information may be used to correlate the location of the connector uniquely with a borehole in which a detonator is positioned. Any suitable modulation technique could be used to impress a unique signal on the identifying signal so that the identity or existence of the connector is accurately ascertainable.

The identifying source may be powered in any appropriate way. In one example of the invention the housing includes an energy supply which powers the identifying source, for example, in response to an interrogating signal transmitted on the harness from an external mechanism such as a control box or blasting machine. Alternatively, the interrogating signal is transmitted wirelessly.

In a different approach power from a remote supply is transmitted along the harness to the connector in order to energise the identifying source, when required.

In another form of the invention an external mechanism transmits an interrogating signal wirelessly or on a harness and energy from the interrogating signal is extracted and used to power the identifying source.

The aforementioned techniques can be used alone or in any appropriate combination.

It is possible to include more than one identifying source in or on the housing. In this instance the identifying sources may, if required, function at different respective frequencies i.e. at different wavelengths.

The housing of the connector may be adapted or constructed so that it is reflective of a signal which lies at a frequency which is the same as or close to the frequency of the identifying signal. For example if the identifying signal lies in the optical frequency range then the housing of the connector may be coloured or be light reflective. This enables the physical location of the housing to be ascertained visually, by using a suitable sensor, e.g. a camera, which is responsive to the colour of the housing or to its light reflective qualities. These aspects are important in dark locations of the kind encountered in underground situations.

"Light reflective" includes the capability to reflect signals in the light (visible) frequency range, in the infrared range or in the ultraviolet range. Thus, generally, the reference to "light" in this specification includes a signal which is in the visible range (this is preferred) but the signal may alternatively be in the infrared or in the ultraviolet range. If the identifying signal is not visually ascertainable then an appropriate detector e.g. an ultraviolet or infrared detector, as the case may be, can be used to ascertain the physical location of the housing.

According to a different aspect of the invention there is provided apparatus for use in a blasting system which includes a harness, a plurality of detonators and a plurality of devices, each of which is of the aforementioned kind, the apparatus including at least one sensor for detecting emission of an identifying signal from at least one said identifying source, a positioning device which generates data which is uniquely related to the physical location of the identifying source which emitted the detected identifying signal and hence to the physical location of a detonator associated with the device, and a processor, responsive to the data relating to the physical location of each detonator, for controlling the transmission of timing data to each detonator in the blasting system.

The processor may be responsive to a memory in which timing data for each detonator is stored beforehand. Upon identifying the physical location of each detonator the corresponding timing data can then be transmitted directly to the detonator. In a variation of this technique the physical location data of each detonator is used in proprietary blasting software to generate timing data which is then transmitted to each respective detonator. This can be done immediately i.e. by using appropriate equipment provided on the apparatus for the purpose. Alternatively the timing data determined by execution of the software is stored and subsequently transferred to each detonator, for example, by means of a blasting machine used to control the operation of the blasting system or by means of any other appropriate equipment.

The at least one sensor in the apparatus may take on any suitable form and for example may include a camera with an image processing capability.

If each device comprises a connector of the aforementioned kind then each connector in the blasting system may include a respective housing which is constructed or adapted so that it is capable of reflecting a signal which lies at a frequency which is close to or the same as the frequency of the identifying signal. Thus if the identifying signal is in the visible frequency range the housing may be coloured or it may be light reflective, or both. These features enable the sensor, or if necessary a second sensor, so be used to establish the physical location or presence of the housing. If the existence of an identifying source is not linked to the physical location of the connector housing, then the processor may generate an alerting signal, audible, visual or electronic, to advise an operator of the situation. In this event remedial action can be taken for, typically, a detonator which is at the location of the connector is either unconnected to the harness or is not working.

BRIEF DESCRIPTION OF THE DRAWINGS

The invention is further described by way of examples with reference to the accompanying drawings in which.

DESCRIPTION OF PREFERRED EMBODIMENTS

Figure 1:
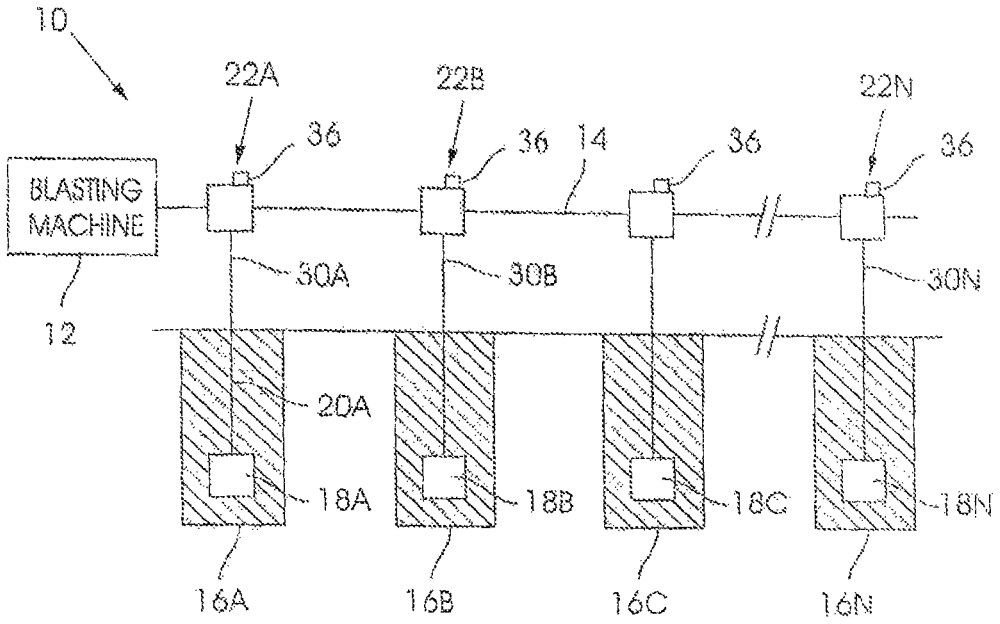
FIG. 1 schematically illustrates a blasting system in which the principles of the invention are used.

FIG. 1 of the accompanying drawings illustrates a blasting system 10 which includes a blasting machine 12, of any suitable type, an elongate harness 14, a plurality of boreholes 16A, 16B, 16C . . . 16N, a plurality of detonators 18A, 18B . . . 18N which are respectively located in the boreholes and which are exposed to respective explosive charges 20A to 20N, and a plurality of connectors 22A, 22B . . . 22N which are respectively used to connect the detonators 18A to 18N to the harness 14.

Although the principles of the invention find particular application in an underground location, this application is exemplary and non-limiting. The principles of the invention are described hereinafter with particular reference to the implementation thereof using signals in a visible frequency range. This is exemplary only and non-limiting for signals which lie in other ranges e.g. infrared or ultraviolet, may be used, as appropriate. The choice of the frequency of the identifying signal can be based on a variety, of factors including availability and cost of appropriate equipment, reliability of detection, the frequency of extraneous or noise signals and the like. The invention is not limited in this respect.

The boreholes 18 are at diverse positions and due to geographical factors and low lighting conditions it may be difficult to ascertain, visually, the precise physical location of each borehole.

Each connector 22A to 22N establishes a respective electrical connection between the harness 14 and a corresponding branch line 30A, 30B . . . 30N which extends to the associated detonator. These connections are made in any convenient manner.

In accordance with one aspect of the invention each connector 22 respectively includes at least one identifying source which is actuable or which can be energised in a controlled manner in order to indicate the physical presence and location of the connector. Preferably an identifying source signals its presence by emitting an identifying signal in an optical frequency range of, say, 400 to 790 terahertz.

Figure 2:
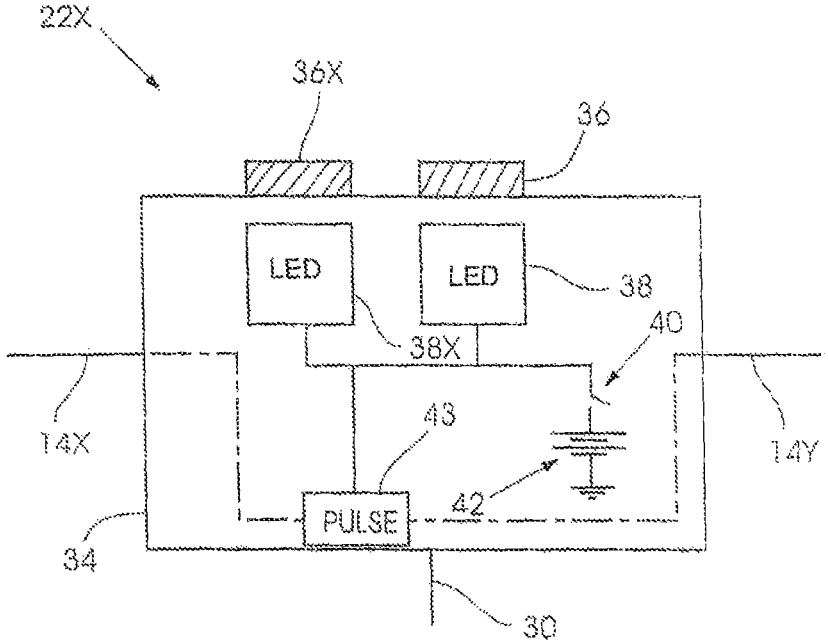
FIGS. 2, 3 and 4 respectively illustrate different connectors which can be used in the blasting system of FIG. 1.

FIG. 2 schematically illustrates a connector 22X which includes a housing 34. The housing has provision for incoming and outgoing connections 14X and 14Y to the harness 14 and for a connection (not shown) from the harness to the associated branch line 30. The housing 34 includes a window 36. An identifying source, in this case a light emitting diode 38, is mounted to the housing adjacent the window. Alternatively the light emitting diode is directly mounted to an aperture which is formed in the housing.

Optionally the housing includes a second window 36X and a second light emitting diode 38X or, if required, additional diodes and windows. The invention is not limited in this respect. Preferably if multiple diodes are used in a connector i.e. in or on one housing, then they operate at different wavelengths. This facilitates the addition of features to the connector.

In the example shown in FIG. 2 a simple switch 40 is located between the diodes and a long-life battery 42. The switch 40 which is electronic, e.g. a semiconductor switch, can be closed in response to an interrogating signal which is sent on the harness 14 from the blasting machine 12 or which is sent wirelessly to the connector from an external source. The latter aspect is further described hereinafter. When the switch 40 is closed each light emitting diode is connected to the battery 42 and emits a distinct identifying signal in the form of a light signal.

Each identifying signal can be emitted continuously or intermittently. Another possibility is to allow a light source to be pulsed in a coded manner using custom-designed software or a logic unit with embedded software (43) so that a code, which uniquely identifies the connector 22X, is emitted. The interrogating signal could also be detected by the logic unit 43 which, as is depicted by dotted lines, would be connected to the harness 14.

In FIG. 2 (and in FIGS. 3 and 4) electrical connections made by the connecter to the harness and branch lines are effected in a conventional manner and are not shown.

Figure 3:
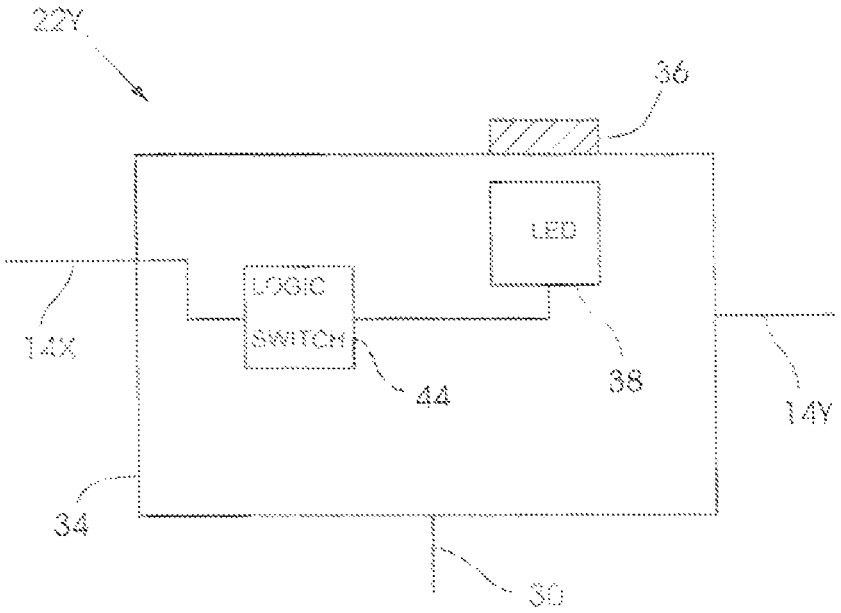

FIG. 3 shows a different connector 22Y. Where applicable like reference numerals are used to designate like components to those shown in FIG. 2. A similar observation is made in respect of a connector 22Z shown in FIG. 4, described hereinafter.

In the FIG. 3 embodiment a combined logic and switch unit 44 is incorporated in the housing 34. The unit 44 is responsive to a signal transmitted on the harness which is destined for the connector 22Y. As an alternative, an appropriate signal could be generated by a mobile interrogating device (not shown). In any event if the incoming signal is recognised by the logic unit 44 then power derived from the harness line 14 (not from an internal battery) is applied to the light emitting diode 38 which is thereby energised to emit an identifying light signal to signify the physical location of the connector 22Y.

Figure 4:
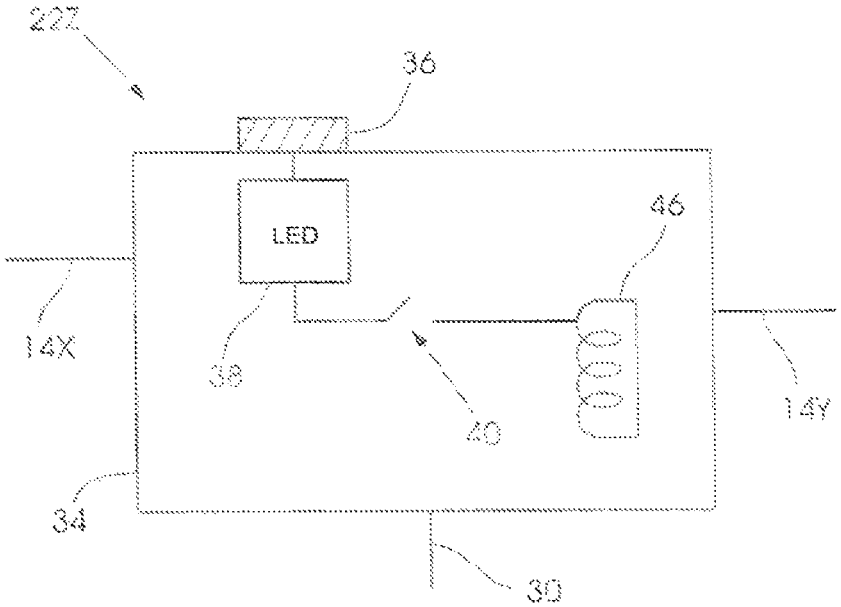

FIG. 4 shows a connector 222 which includes a coil 46 which is connected to an LED 38. The coil 46 is a receiving loop antenna and interacts with an electromagnetic signal sent, wirelessly, by an interrogating device (not shown). Electrical energy induced into the coil is used to energise the light emitting diode 38. The arrangement shown in FIG. 4 is responsive only when the interrogating signal is sufficiently strong and this, in turn, means that the interrogating device must be fairly close to the connector. A logic unit, not shown, could be included in the connector to pulse or modulate an identifying light signal, emitted by the diode 38, in a manner which is uniquely associated with the connector 22Z.

In the examples shown in FIGS. 2 and 3 the light source (typically a light emitting diode) is powered by means of an energy source, e.g. a battery, on or in the connector. This is exemplary only. The battery could for example be located on or in a detonator which is associated with the connector.

In the FIG. 4 embodiment energy from an interrogating signal is used to power the light emitting diode. This is via a coil associated with the connector.

Another possibility is to transmit power from external apparatus (not shown) to the light source, for example by using the harness as an energy conducting medium. The invention is therefore not limited by the way in which the energy is delivered to the light source and the various examples which have been given are non-limiting.

Figure 5:
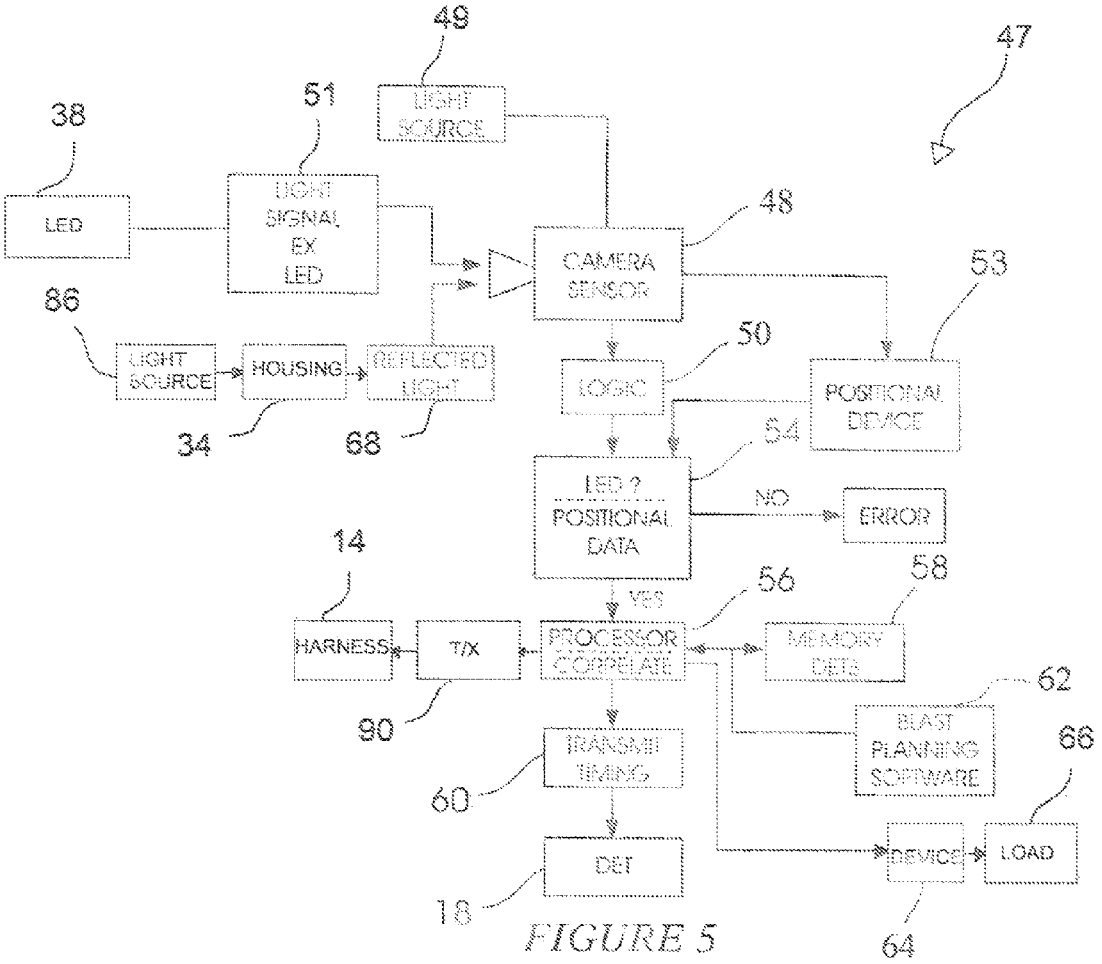
FIG. 5 depicts components of apparatus according to the invention and steps which are implemented during the establishment of the blasting system in FIG. 1.

FIG. 5 shows some operational aspects which are carried out during the establishment of the blasting system 10, and components of apparatus 47 according to the invention used for this purpose.

A detector 48 is used to detect the emission of an identifying light signal by a light source on a connector. The detector includes any appropriate light sensitive sensor and, for example, use is made of a camera which has an image processing capability. Upon detecting light 49 from any light source a signal is sent by the sensor 48 to a logic unit 50 which executes an algorithm, based at least on the amplitude and frequency of light emitted by a light emitting diode, to verify that the signal did come from a light emitting diode included in the blasting system, and not from an extraneous source.

If an identifying signal (51) is positively identified as coming from an LED 38 then a positional device 53 associated with the detector 48 generates positional data 54 which uniquely specifies the physical location of the light source which was identified.

The positional data is supplied to a processor 56 which takes the positional data and attempts to correlate (match) this with data held in a memory unit 58 in which an identity of each detonator in the blasting system is recorded.

An objective of the invention is to ensure that timing data, which controls the time instant at which each detonator is ignited, is correctly transferred to each detonator. This aspect can be handled in different ways. In one approach, shown schematically in FIG. 5, the memory unit 58, apart from storing the identity of each detonator, includes the timing data which is to be transferred to each detonator. Then, provided a correlation is established between the positional data and the detonator information in the memory unit 58, the timing data, taken from the memory unit, is automatically transmitted in a step 60 to the detonator 18 in question. The timing data can be loaded directly into the detonator at the time. It can however be recorded and subsequently transmitted to the blasting machine 12 which, at an appropriate stage, transfers the respective timing value to each detonator using the electronic address of the detonator for this purpose. Other equipment, in place of the blasting machine, can be used for this purpose.

In another approach the processor 56 executes a proprietary program 62 relating to a desired blasting plan (for the blasting system) and by using the positional data generates the appropriate data for the detonator and then transmits the timing data to each detonator. In a further variation the processor 56 transmits the positional data to another device 64, which may be hand-held by an operator, or which may be off-site and that device, in a similar manner, generates the timing data and, at an appropriate stage, this data is loaded (66) into each detonator.

The transferring of the timing data to each detonator can be done wirelessly, by using light signals, or by impressing appropriate signals on the harness. The invention is not limited in this respect.

The detector camera 48 detects the light which is emitted by a light emitting diode. If desired the detector could have a capability to cause a light emitting diode within a specific distance or range to be energised, i.e. the detector could be used in an interrogating manner. In any event, the detector, by responding to light 51 from an LED 38, uniquely identifies a physical location of a borehole, at a blast site, using the connector as a locating device. As indicated, this information is matched by the processor 56 to the identity, i.e. electronic address, of the detonator stored in the memory unit 58. Any of the techniques mentioned, or any equivalent technique, can then be used to assign the correct timing value to each detonator based on the physical location of the detonator and then to write the timing value into the detonator.

The system thus determines the physical location of each detonator. If the number of detonators is known then a simple count can be done to verify whether all detonators have been included in the blasting system or whether any have been omitted.

In a modification of the aforementioned process each housing 34 is coloured or includes a light-reflective material. The camera 48 is capable of detecting the housing 34 of a connector 22 by looking for a reflected light signal 68. Any suitable light source 86 can be used to illuminate an area in order to locate a housing, using reflected light. This is in addition to detecting the light signals which are emitted by the fight emitting diodes. Any connector detected by the camera that is then not associated with a light source (light emitting diode) can be identified. Typically this would be due to the fact that a connector is not connected to the harness or to a corresponding detonator, or that the connector is connected to a detonator which is not functioning. Appropriate remedial action can therefore be taken before the blast sequence is executed.

If the invention is implemented at a frequency which is not in the visible frequency range then each housing is constructed or otherwise adapted so that it can reflect a signal which lies at a frequency which is close to or equal to the frequency at which the identifying signal is emitted.

Figure 6:
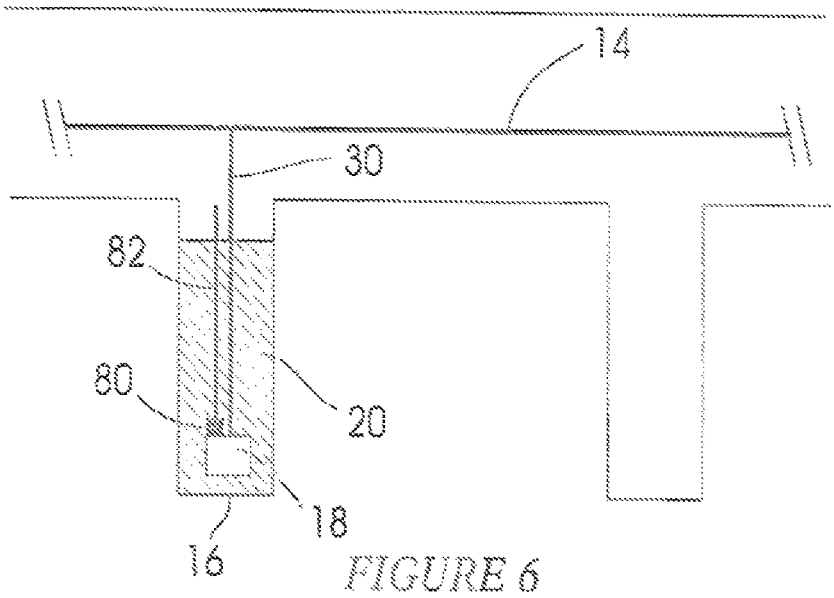
FIG. 6 shows a device which is usable in place of the connector shown in FIGS. 2, 3 and 4.

In another variation of the invention shown in FIG. 6, in place of or in addition to providing a light source (LED) in a connector, a light source 80, typically an LED, is mounted inside or on a detonator 18 and a light conductor 82, such as an optical fibre or light pipe, is used to transmit light from the source to a position at which the light is visible for example (depending on the situation) out of a borehole 16 in which the detonator is installed, or to a connector, etc. In effect the light source 80 replaces the LED 38 described particularly in connection with FIGS. 2, 3 and 4 but otherwise can be energised or actuated in a similar way, e.g. by means of an on-board power source on the detonator or by means of energy extracted from a signal transmitted on the harness 14. The light emitted by the light source could be pulsed or modulated so that it is uniquely associated with the detonator with which the light source is used.

The invention may be implemented using a positioning system which generates positional data but this is not essential. As is evident from the preceding description a primary objective is for the identifying source to be capable of emitting a signal which can identify a physical location of the detonator. If the signal is in the optical frequency range then the position detonator is immediately ascertainable. If the signal is in a range which lies outside the optical frequency range i.e. it is not directly visible to a user then appropriate detectors can be used to detect a signal in the ultraviolet range or in the infrared range, as the case may be.

If a blast site permits the use of a global positioning system then this is a convenient way of providing positional data. If a GPS cannot be used then a local positioning system can be established at the blast site and used as appropriate to give the required positional data. In this respect it should be borne in mind that the positional data at the blast site is relative, i.e. the location of each detonator will be related to a reference location or locations and, not necessarily, to the absolute position (in a geographical sense) of each detonator.

Figure 7:
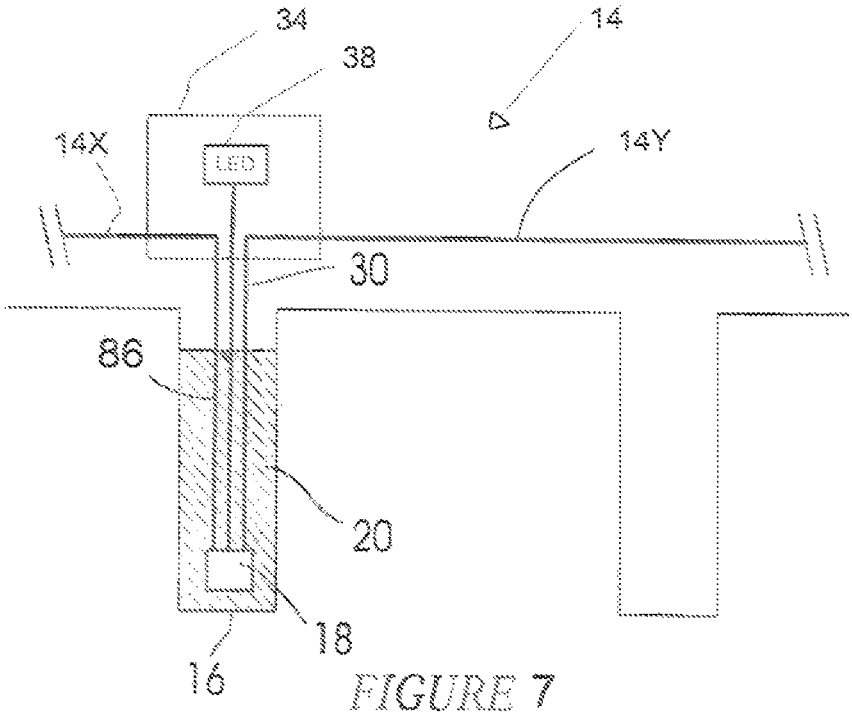
FIG. 7 illustrates another embodiment of the invention.

FIG. 7 shows another form of the invention. A detonator 18, positioned in a borehole, includes logic which via conductors 86 can control the operation of an LED 38 which is in or on a housing 34 associated with a connector used to couple the detonator to a harness 14. In contrast to the arrangement in FIG. 6 the LED is at the surface and is not within the borehole.

Conveniently the hardware and software required to implement the aforementioned principles can be incorporated in a compact form of apparatus, intended to fall within the scope of the invention, embodying at least the camera/sensor 48, the processor 56, which can implement the required logic and the correlating function, and the memory unit 58. The apparatus 47 could incorporate a positional device 53 or otherwise should be capable of communicating with a positional device. If a connector has a reflective housing and is to be located, then the apparatus 47 may include a light source 86 to illuminate the surroundings so that the sensor 48 can detect light reflected by the reflective housing. If the apparatus is to be used to transmit timing data to each detonator then some form of transmitter 90, preferably with a receiving capability, is required i.e. either a wireless or optical device or some mechanism which can be directly connected to the harness 14. The transmitter/receiver 90 can be used for transmitting positional and identity information to an off-site facility at which blast planning software is run to determine timing information. In the variation of the invention the blast planning software is held in the memory unit 58 and is then executed, as required, by the processor 56 incorporated in the apparatus of the invention.

The invention claimed is:

1. A device for use in a blasting system which includes a plurality of detonators, wherein the device is associated with one detonator and includes at least one identifying source which is actuable to emit an identifying signal at a frequency which lies in a defined frequency range thereby to identify a physical location of the detonator and a connector for making a connection between the detonator and a harness in the blasting system, and wherein the connector includes a housing and at least one said identifying source is inside or on the housing.

2. A device according to claim 1 wherein the frequency of the identifying signal is in the ultraviolet, infrared or optical frequency range.

3. A device according to claim 1 wherein the identifying source is pulsed in a coded manner so that the housing is uniquely identified.

4. A device according to claim 1 wherein a conductor is used to transmit said identifying signal from the identifying source to a position at which the identifying signal is detectable.

5. A device according to claim 1 wherein the housing of the connector reflects a signal which is at or close to the frequency of the identifying signal.

6. Apparatus for use in a blasting system which includes a harness, a plurality of detonators and a plurality of devices, each device being associated with one detonator and including an identifying source which is actuable to emit an identifying signal at a frequency which lies in a defined frequency range thereby to identify a physical location of the detonator, the apparatus including at least one sensor for detecting emission of said identifying signal from at least one said identifying source, a positioning device which generates data which is uniquely related to the physical location of the identifying source which emitted the detected identifying signal and hence to the physical location of the detonator associated with the device, and a processor, responsive to the data relating to the physical location of each detonator, for controlling the transmission of timing data to each detonator in the blasting system.

7. Apparatus according to claim 6 which includes a memory unit for the storage of timing data, and identifying information, relating to each detonator.

8. Apparatus according to claim 6 wherein the processor, in use, determines timing data associated with each respective detonator.

9. Apparatus according to claim 6 wherein the detonator includes said identifying source mounted inside or on the detonator and a conductor is used to transmit said identifying signal from the identifying source to a position at which the identifying signal is detectable.

10. Apparatus according to claim 6 wherein the detonator includes a connector for making a connection between the detonator and the harness, wherein the connector includes a housing and at least one said identifying source is inside or on the housing.

11. Apparatus according to claim 10 wherein the housing of the connector reflects a signal which is at or close to the frequency of the identifying signal.

12. Apparatus according to claim 10 wherein the identifying source is pulsed in a coded manner so that the housing is uniquely identified.

13. A device for use in a blasting system which includes a plurality of detonators, wherein the device is associated with one detonator and includes at least one identifying source which is actuable to emit an identifying signal at a frequency which lies in a defined frequency range thereby to identify a physical location of the detonator and a connector for making a connection between the detonator and a harness in the blasting system, wherein the connector includes a housing and said at least one identifying source is inside or on the housing.

* * * * *